US007249544B2

(12) United States Patent
Totsu

(10) Patent No.: US 7,249,544 B2
(45) Date of Patent: Jul. 31, 2007

(54) SCREW HOLDING TYPE SCREWDRIVER BIT AND COMBINATION THEREOF WITH SCREWS

(76) Inventor: Katsuyuki Totsu, 32-13, Oshiage 1-chome, Sumida-ku, Tokyo (JP)

( * ) Notice: Subject to any disclaimer, the term of this patent is extended or adjusted under 35 U.S.C. 154(b) by 39 days.

(21) Appl. No.: 10/512,000

(22) PCT Filed: Mar. 27, 2003

(86) PCT No.: PCT/JP03/03774

§ 371 (c)(1),
(2), (4) Date: Oct. 15, 2004

(87) PCT Pub. No.: WO03/086713

PCT Pub. Date: Oct. 23, 2003

(65) Prior Publication Data

US 2005/0115370 A1 Jun. 2, 2005

(30) Foreign Application Priority Data

Apr. 18, 2002 (JP) ..... 2002-115972

(51) Int. Cl.
*B25B 23/08* (2006.01)

(52) U.S. Cl. ..... 81/452; 81/448

(58) Field of Classification Search ..... 81/452, 81/451, 125, 443, 448
See application file for complete search history.

(56) References Cited

U.S. PATENT DOCUMENTS 518,472 A * 4/1894 Snyder ..... 81/448
3,224,479 A * 12/1965 Osborn et al. ..... 81/443
3,286,749 A 11/1966 Leamed
3,517,714 A * 6/1970 Desbarats ..... 81/451
4,007,768 A 2/1977 Matsushima
4,060,114 A * 11/1977 Matsushima ..... 81/448
4,800,788 A * 1/1989 Goldstein ..... 81/451

FOREIGN PATENT DOCUMENTS

JP S46-31719 9/1971
JP S47-596 1/1972
JP S47-36000 11/1972
JP S48-9440 3/1973

(Continued)

*Primary Examiner*—Hadi Shakeri
(74) *Attorney, Agent, or Firm*—Koda & Androlia

(57) ABSTRACT

A screw holding screwdriver bit capable of effectively preventing a come-out from occurring by improving the structure of the blade portions thereof, capable of being manufactured in a simple structure at a low cost, and capable of remarkably increasing a working efficiency by allowing an appropriate and rapid screw tightening operation at all times, and the combination thereof with screws, the driver bit including a plurality of blade portions (12) having generally vertical end edge portions (13) formed at the tip ends (12*a*) thereof, wherein one of the blade portions (12) is cut out in the axial direction of the bit, a guide passage (16) of a specified length is provided in a shaft (11) portion continued generally on the extension of the cutout portion (15) of the blade portion, and an elastic piece (18) allowed to elastically abut on a bit engagement groove in a screw head and having a screw holding function by the interaction thereof with the blade portion fitted in the bit engagement groove is inserted in the guide passage.

7 Claims, 13 Drawing Sheets

FOREIGN PATENT DOCUMENTS

| | | |
|---|---|---|
| JP | S49-22519 | 6/1974 |
| JP | S51-148795 | 11/1976 |
| JP | S54-117698 | 8/1979 |
| JP | S60-100162 | 7/1985 |
| JP | H7-328946 | 12/1995 |
| JP | H8-71939 | 3/1996 |
| JP | H8-145024 | 6/1996 |

* cited by examiner

SCREW HOLDING TYPE SCREWDRIVER BIT AND COMBINATION THEREOF WITH SCREWS

TECHNICAL FIELD

The present invention relates to a screw holding type screwdriver bit and a combination with screws that is applied to such a screwdriver bit.

BACKGROUND ART

The inventor of the present application has previously developed various screwdrivers. They are constructed so that an anchoring pin is disposed on the blade tip of the screwdriver, and the blade tip and the slot of the screw head are engaged and caused to adhere tightly to each other utilizing the elastic force of the anchoring pin, as a means for attaching and holding the screw head in the blade tip of the screwdriver when the blade tip of the screwdriver is engaged with the slot formed in the screw head, transporting the screwdriver and screw to a desired position, and securely performing a screw-in operation. The applicant has obtained patents for these screwdrivers (Japanese Patent Application Publication (Kokoku) No. S46-31719, Japanese Patent Application Publication (Kokoku) No. S47-596 and Japanese Patent Application Publication (Kokoku) No. S48-9440).

Screwdrivers equipped with a such screw holding means have a structure in which a blade piece that has a blade holding pin is detachably engaged with a screwdriver bit holder which is provided with a blade piece clamping groove and a blade piece insertion hole formed in its tip end portion. In this structure, the blade piece that has a blade holding pin is provided with a blade piece main portion, which has a broader diameter than the screwdriver bit holder, and a supporting tail portion, which extends while being slightly bent in the side surface from the center of the upper edge; and one end of an elastic pin is fastened to one side surface of the upper end of the supporting tail portion, and the other end of the elastic pin is extended to the vicinity of the lower end of an anchoring projecting portion that is disposed on the center of the lower edge of the blade piece main portion, so that the elastic is separated from the blade piece.

Screwdrivers equipped with a screw holding means constructed as described above are used with special screws which have a slot consisting of a rectilinear groove that is formed in the screw head so that the groove cuts across the center of the screw head and which have an anchoring hole that has a diameter greater than the groove width of the rectilinear groove and is formed in the center of the rectilinear groove. Accordingly, it is difficult to make screwdrivers equipped with a screw holding means of type described above usable on numerous different types of screws that have diverse screw engagement grooves such as the screws that are seen today.

In the past, therefore, a tool, which includes a tubular member, a sliding member, a sliding driving member, a chucking member and a closing direction driving member, has been proposed as a power tool that can cause attachment and detachment with respect to a screw in an accurate, secure, easy and safe manner (Japanese Patent Application Laid-Open (Kokai) No. H7-328946). In this tool, the tubular member is fastened to the non-rotating portion of a power tool that has a rotating shaft that rotates the screw; and the sliding member is engaged with the inner circumferential side of the tubular member so that the sliding member can slide in the axial direction by a specified dimension, and this the sliding member has an axially oriented through-hole into which the rotating shaft of the power tool is inserted. The sliding driving member drives the sliding member in a direction that causes this sliding member to protruded from the tubular member. The chucking member has a spreading screw head guide surface, which is formed on the inside of the tip end, and a screw head gripping surface, which is connected to the rear end of the guide surface and supports the head portion of the screw so that the axial center of the screw coincides with the axial center of the rotating shaft; and this chucking member is attached to the sliding member so that the chucking member can open and close in the direction of its diameter. Furthermore, the closing direction driving member drives the sliding member in the closing direction.

In a power tool constructed in this manner, when the sliding member is caused to move into the tubular member by a specified dimension against the driving force of the sliding driving member, a chucking member consisting of claws disposed in three locations at substantially equal intervals along the outer circumferential surface of the sliding member is locked in a closed state by the tubular member. On the other hand, when the sliding member protrudes from the tubular member in accordance with the driving force of the sliding driving member, the locking of the chucking member is released.

Furthermore, as an alternative, a tool that includes an engaging shaft, a screw holder and an urging means is proposed as a screw holding device for an electric power tool (Japanese Patent Application Laid-Open (Kokai) No. H-8-71939). In this tool, the engaging shaft has a bit attached to the tip end in a detachable manner; and the screw holder is attached to this engaging shaft so that the screw holder can slide but cannot slip off so that at least three elastic holding pieces are disposed in a direction in which the tip ends of these elastic holding pieces open away from each other and the peripheries of these elastic holding pieces are covered by tubular covers that are open at the tip end. In addition, the urging means urges the screw holder in the direction of the tip end of the engaging shaft.

In this screw holding device, when it is coupled to the drive shaft of an electric power tool, and the head of a screw is press-fitted from the tip end opening of the cover of the screw holding device to which a bit corresponding to the tip end is attached, the elastic holding pieces are bent to the outside, so that the screw head rides over the shallow inverted "V" shaped bent portion, and the crew head is inserted to a position in which the screw head engages with the bit. In this state, the elastic holding pieces recover their original shape as a result of their own elastic force and press against the circumference of the neck of the screw, thus holding the screw so that the screw is prevented from slipping out.

However, in the screwdrivers equipped with a conventional screw holding means as described above, not all of these screwdrivers are screwdrivers that hold the screw by being engaged with the bit engagement groove formed in the screw head, and some of these screwdrivers elastically chuck the outer circumference of the screw head or hold the circumference of the neck of the screw by pressing contact using elastic holding pieces. Accordingly, while screwdrivers equipped with the conventional screw holding means are advantageous in that they do not use a magnet, these screwdrivers conversely involve the difficulties. Namely, the shapes and structures of the chucking member or elastic holding pieces are complicated, the number of parts required is large, and some trouble must be taken in order to manufacture these screwdrivers. Moreover, there is also an increase in the manufacturing cost, etc.

The inventor of the present application previously developed a screw and screwdriver bit combination. In this combination, an improvement was made in the structure of the groove in the bit engagement groove formed in the head of a screw, so that the phenomenon of "come-out" of the screwdriver bit is effectively prevented in screw tightening work, thus preventing damage to the screw head of the type seen in conventional screwdrivers, quick and suitable screw tightening work is accomplished even in cases where some damage is generated in the bit engagement groove of the screw, and the working efficiency is extremely high. The inventor filed a patent application for this screw and screwdriver bit combination (Japanese Patent Application Laid-Open (Kokai) No. H8-145024).

In the screw and screwdriver bit combination in the above-described proposal, a vertical end wall with a specified depth is formed in the end edge portion of the bit engagement groove of the screw head, horizontal step portions are respectively formed from the vertical end edge portions, and respective inclined grooves are formed as extensions toward the center of the neck of the screw from these horizontal step portions. Furthermore, a substantially circular conical bottom surface is formed in the bottom, and the screw is combined with a screwdriver bit equipped with a vane that engages with the vicinity of the horizontal step portions.

In the screw constructed in this manner, when the tip end of the screwdriver bit and the bit engagement groove are engaged, the taper contact surface area with respect to the overall bit engagement groove is partial and small; moreover, since the vertical end wall and horizontal step portions are disposed so that the area of the side wall contacted by the tip end of the screwdriver bit in the boundary between adjacent bit engagement grooves is expanded, the advantage of the secure prevention of the phenomenon of "come-out" of the screwdriver bit is obtained. Furthermore, it is also confirmed that in the screw constructed in this manner, since vanes having substantially perpendicular edges that engage with the horizontal step portions formed in the end edges of the bit engagement groove of the screw are respectively disposed, a screwdriver bit that is most suitable for the screw is obtained.

Accordingly, the inventor of the present application, as a result of various investigations and trials, ascertained that a screw holding type screwdriver bit with versatility and a combination thereof with a screw, which are relatively simple in structure and manufactured easily at low cost, can be obtained by a structure that includes: a plurality of blade portions in which substantially perpendicular end edge portions are formed in the tip ends of the blade portions, a part of one of the blade portions being cut out in a direction of the axis of the screwdriver bit; a guide passage which has a specified length and is formed in the screwdriver bit's shaft portion that forms a continuation on a line which is substantially an extension of the cut-out; and an elastic piece inserted and disposed in the guide passage so that the elastic piece elastically contacts a bit engagement groove of the head portion of a screw and has a screw holding function as a result of interaction with blade portions that are inserted into the bit engagement groove.

Accordingly, the object of the present invention is to provide a screw holding type screwdriver bit and a combination thereof with a screw that, by modification of the structure of the blade portion of the screwdriver bit, effectively prevent the phenomenon of "come-out", have a simple structure and are easy to manufacture at low cost and perform quick and suitable screw tightening work at all times, thus improving the working efficiency conspicuously.

DISCLOSURE OF INVENTION

In order to accomplish the above object, the screw holding type screwdriver bit of the present invention is characterized in that the screwdriver bit comprises: a plurality of blade portions in which substantially perpendicular end edge portions are formed in tip ends of the blade portions, a part of one of the blade portions being cut out in a direction of an axis of the screwdriver bit; a guide passage which has a specified length and is formed in a part of a shaft portion of the screwdriver bit, such part being on a line that is substantially an extension of the cut-out of the blade portion; and an elastic piece inserted and disposed in the guide passage, the elastic piece elastically contacting a bit engagement groove of a head of a screw and having a screw holding function as a result of interaction with blade portions that are inserted into the bit engagement groove.

In this structure, the guide passage can be a long groove that has a specified length and is formed directly in the shaft portion of the screw holding type screwdriver bit on a line that is substantially an extension of the cut-out of the blade portion.

A protective sleeve that surrounds the blade portions and elastic piece so that the tip ends of the blade portions and elastic piece are respectively exposed can be provided on the outer circumference of the shaft portion of the screwdriver bit in which the elastic piece is inserted and disposed.

In addition, the present invention is characterized in that the shaft portion of the screw holding type screwdriver bit can be further cut out along a line that is substantially an extension of the cut-out of the blade portion, so that the guide passage is formed along the cut-out by the protective sleeve that covers the outer circumference of the shaft portion.

Furthermore, the screw holding type screwdriver bit of the present invention is characterized in that the screwdriver bit comprises:

a plurality of flat blade portions in which substantially perpendicular end edge portions are formed on tip ends thereof, central portions of the tip ends of the flat blade portions being formed into a circular conical projection;

a long groove which has a specified length and is formed in a part of a shaft portion of the screwdriver bit so that the long groove is located on a line that is substantially an extension of a cut-out made in a part of one of the flat blade portions in a direction of the axis of the screwdriver bit; and an elastic piece inserted and disposed in the long groove, the elastic piece elastically contacting a bit engagement groove of a head of a screw and having a screw holding function as a result of interaction with the flat blade portions that are inserted into the bit engagement groove.

In this structure, the tip end of the elastic piece that has the screw holding function can be inserted and disposed in the long groove so that the tip end is offset in the circumferential direction with respect to the flat blade portion that is cut out.

In addition, the long groove can be formed so as to have a width that is greater than the thickness of the flat blade portion that is cut out, and the elastic piece that has the screw holding function can be inserted and disposed in this the long groove while being bent in the circumferential direction of the screwdriver bit's shaft portion.

Furthermore, the long groove can be formed in a position that is offset in the circumferential direction with respect to the position of the flat blade portion that is cut out, and the rear end of the elastic piece that has the screw holding function can be inserted and disposed so that the rear end is anchored in the long groove.

Furthermore, the tip end of the elastic piece that has the screw holding function can be inserted and disposed in the long groove so that the tip end is offset outward in the radial direction with respect to the flat blade portion that is cut out.

In this structure, the long groove can be formed so as to have a width that is substantially equal to or slightly greater than the thickness of the flat blade portion that is cut out, and the elastic piece that has the screw holding function can be inserted and disposed so that the elastic piece is bent in the radial direction of the shaft portion.

In addition, a screw holding sleeve, which surrounds the screw head that is held by the flat blade portions and elastic piece, can be provided on the outer circumference of the screwdriver bit's shaft portion, which has the elastic piece that has the screw holding function and is inserted and disposed in the long groove, so that the screw holding sleeve is elastically movable in the axial direction of the screwdriver bit.

Furthermore, the combination of a screw holding type screwdriver bit and a screw of the present invention is characterized in that the combination comprises:

a screw that is formed with a bit engagement groove and a circular conical bottom, wherein the bit engagement groove is provided in the head of the screw and has a substantially perpendicular end wall and two side walls disposed in the open end edge of the bit engagement groove, and the circular conical bottom is formed downward from the lower edge of the end wall to the center of the neck of the screw; and a screw holding type screwdriver bit that includes: a plurality of blade portions in which substantially perpendicular end edge portions thereof are formed in the tip ends of the blade portions, a part of one of the blade portions being cut out in the direction of the axis of the screwdriver bit; a guide passage which has a specified length and is formed in the screwdriver bit' shaft portion that forms a continuation on a line that is substantially an extension of the cut-out of the blade portion; and an elastic piece inserted and disposed in the guide passage, the elastic piece elastically contacting the bit engagement groove of the head of the screw and having a screw holding function as a result of interaction with the blade portions that are inserted into the bit engagement groove.

EXPLANATION OF SYMBOLS

| | |
|---|---|
| 10 Screw holding type screwdriver bit | |
| 10A, 10B, 10C Screw holding type screwdriver bit | |
| 11 Shaft | 11a Cut-out |
| 12 Flat blade portion | 12a Tip end portion of flat blade portion |
| 12' Corner portion of modified hexagonal shape | 13 End edge portion |
| 14 Projecting portion | 15 Cut-out |
| 15' Cut-out | 15" Cut-out |
| 16 Long groove (guide passage) | 16a Rear end of long groove |
| 17A Anchoring recess | 17B Anchoring groove |
| 18 Elastic piece | 18a Tip end portion of elastic piece |
| 18b Bent portion of elastic piece | 18c Rear end of elastic piece |
| 19A Anchoring projection | 19B Anchoring projection |
| 20 Protective sleeve | 20a Mounting end |
| 21 Bend forming portion | 22 Guide passage |
| 23 Elastic piece holding pin | 24 Guide passage |
| 30 Screw | 30A, 30B, 30C Screws |
| 30a Screw head | 30b Screw neck |
| 32 Bit engagement groove | 32a Opening end edge |
| 33a End wall | 33b Side wall |
| 34 Horizontal step portion | 35 Circular conical bottom |
| 40 Screw holding sleeve | 42 Coil spring |
| 44 Screw base | |

BEST MODE FOR CARRYING OUT THE INVENTION

Next, embodiments relating to the screw holding type screwdriver bit and the combination thereof with a screw of the present invention will be described in detail below with reference to the accompanying drawings.

Embodiment 1

Figure 5:
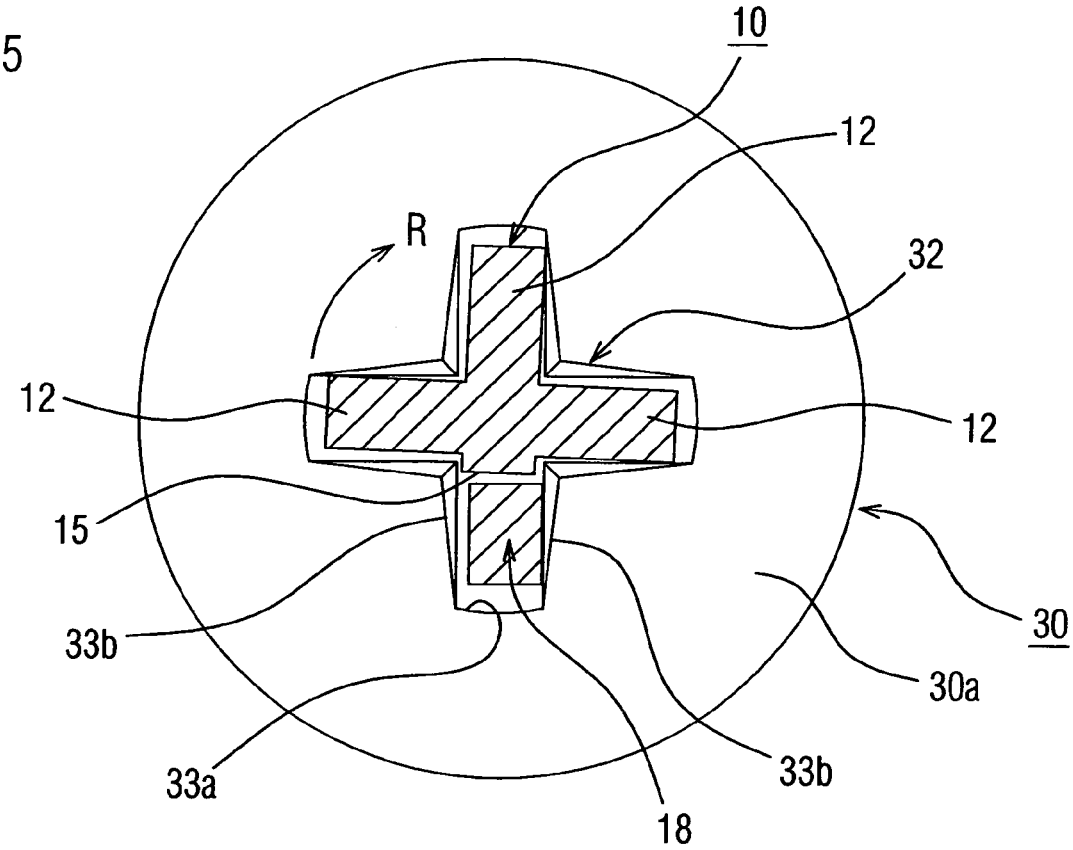
FIG. 5 shows one embodiment of a screw used with the screw holding type screwdriver bit of the present invention, being a sectional plan view of the essential portion of the head of a screw in a state in which the screw is held by the screw holding type screwdriver bit.
Figure 6:
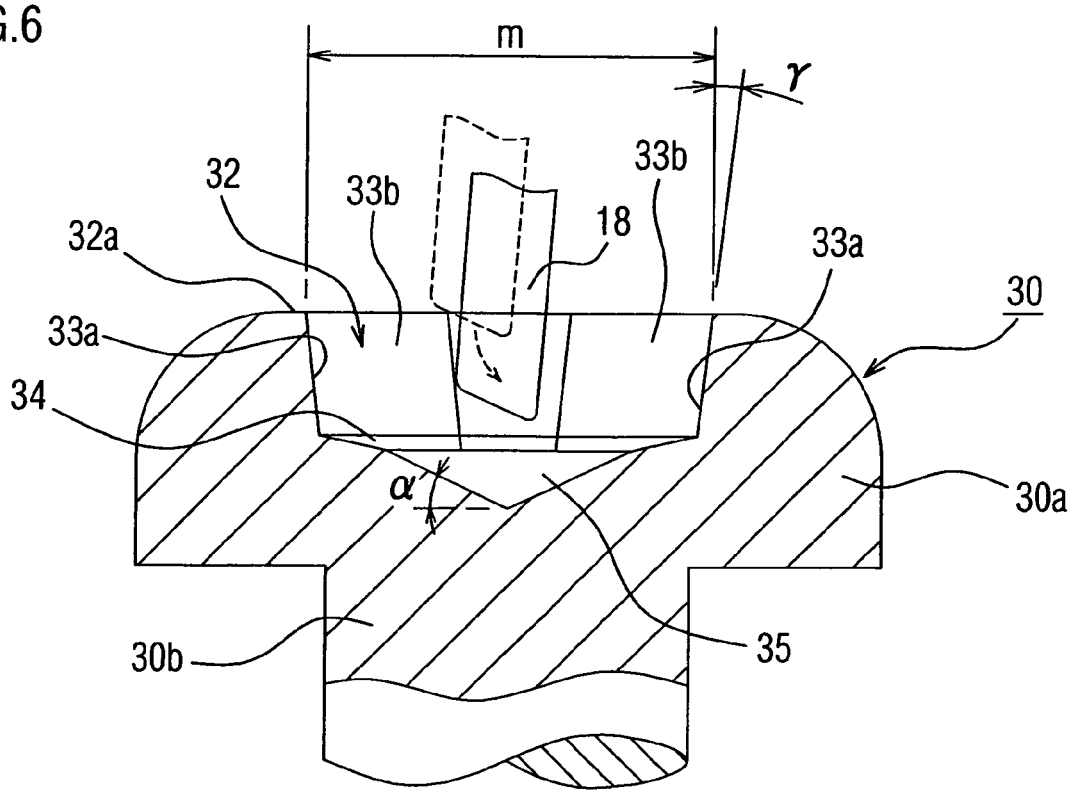
FIG. 6 is a sectional side view of the essential portion of the screw head, showing the state of transition to the holding of the screw by the screw holding type screwdriver bit in the screw head shown in FIG. 5.

FIGS. 1 through 4 show one embodiment of the screw holding type screwdriver bit of the present invention. FIGS. 5 and 6 show one embodiment of a screw that is used with the screw holding type screwdriver bit of this embodiment. More specifically, in FIGS. 1 through 4 and FIGS. 5 and 6, the reference symbol 10 shows the essential portion of the screw holding type screwdriver bit of this embodiment; and this screw holding type screwdriver bit is constructed so that the tip ends 12*a* of the blade portions 12 at the tip end of the shaft portion 11 of the screwdriver bit 10 fit the bit engagement groove 32 formed as a cruciform groove in the center of the head 30*a* of a screw 30.

Accordingly, the screw holding type screwdriver bit 10 of this embodiment includes a plurality of flat blade portions 12 (four blade portions in the shown example) which engage with the bit engagement groove 32 of the screw 30 and have substantially perpendicular end edge portions 13. These perpendicular end edge portions 13 respectively engage with substantially perpendicular end walls 33*a* and side wall 33*b*, 33*b* (on both sides), which are formed in the open end edges of this bit engagement groove 32, and further with a circular conical bottom 34. Furthermore, in correspondence with the circular conical bottom 34 that is formed toward the center of the neck 30*b* of the screw from the end walls 33*a* of the bit engagement groove 32, the central portions of the tip ends of the flat blade portions 12 are formed into a circular conical projection 14 that has an angle of inclination θ of 1° to 45°, preferably an angle of inclination θ of 25° to 35°, with respect to the horizontal plane.

More specifically, the screw holding type screwdriver bit 10 of this embodiment has a structure wherein for the plurality of flat blade portions 12 in which substantially perpendicular end edge portions 13 are formed in the tip ends 12*a*, a portion of one of the flat blade portions 12 is cut out in the axial direction of the screwdriver bit, a long groove 16 of a specified length is formed in a part of the shaft portion 11 that is substantially on an extension line L of the cut-out 15 of the flat blade portion, and an elastic piece 18 that elastically contacts the substantially perpendicular side wall surface 33*b* of the bit engagement groove 32 of the head 30*a* and has a screw holding function in connection with the flat blade portions 12 that are inserted into the bit engagement groove 32 is inserted and disposed inside this long groove 16. The structure further includes a protective sleeve 20 is provided on the outer circumference of the shaft portion 11 in which the elastic piece 18 that has a screw holding function is inserted and disposed in the long groove 16, so that protective sleeve 20 surrounds the flat blade portions 12 and elastic piece 18 in a state in which the tip end projecting portions 12*a* of the flat blade portions 12 and the tip end 18*a* of the elastic piece 18 are exposed. The protective sleeve 20 can be, for instance, fitted into a cut-out 11*a* formed in a part of the outer circumference of the shaft portion 11 in the mounting end 20*a* with respect to the shaft portion 11, and fastened by crimping.

Figure 1:
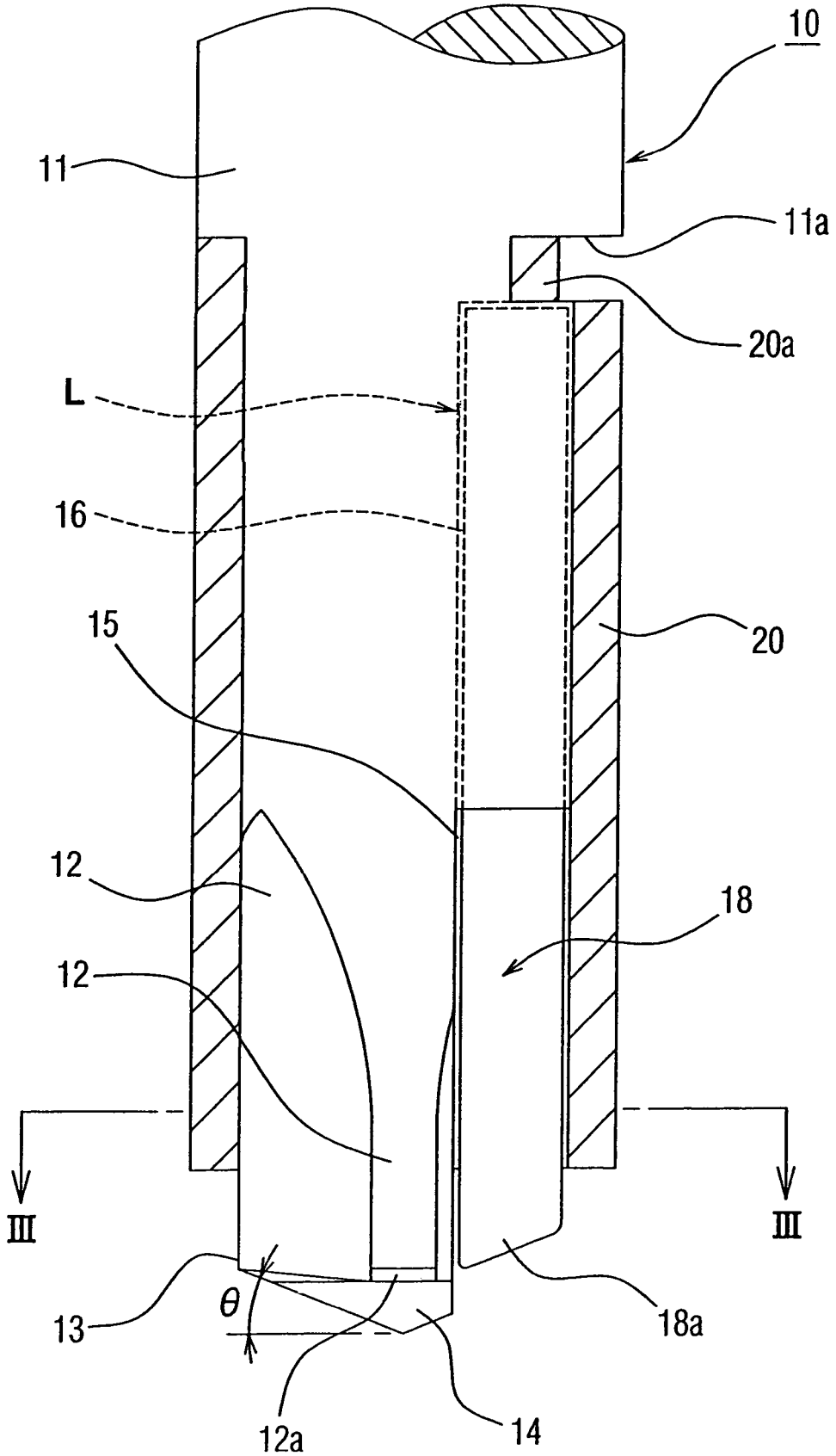
FIG. 1 is a sectional side view that shows the essential portion of one embodiment of the screw holding type screwdriver bit of the present invention.
Figure 2:
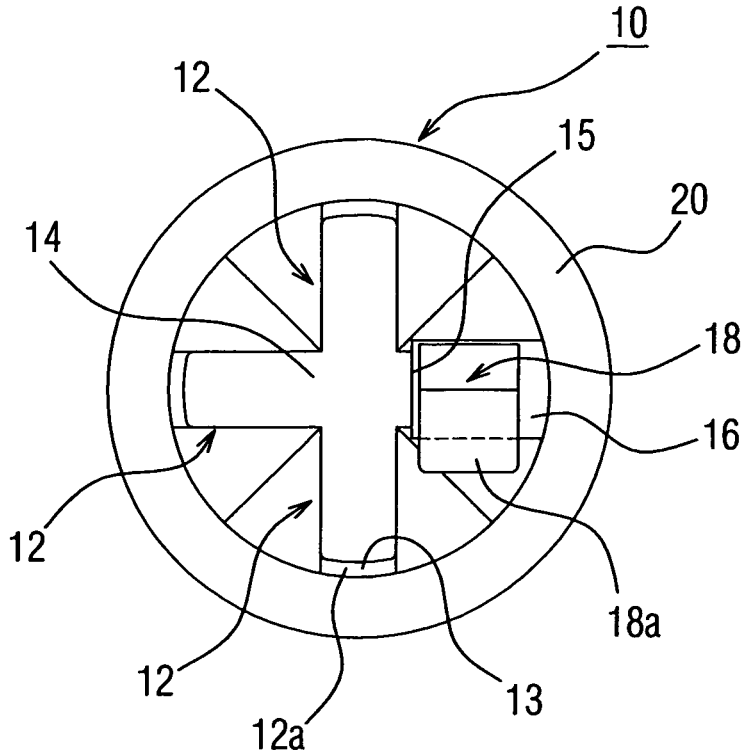
FIG. 2 is an end view of the bit tip end of the screw holding type screwdriver bit shown in FIG. 1.
Figure 3:
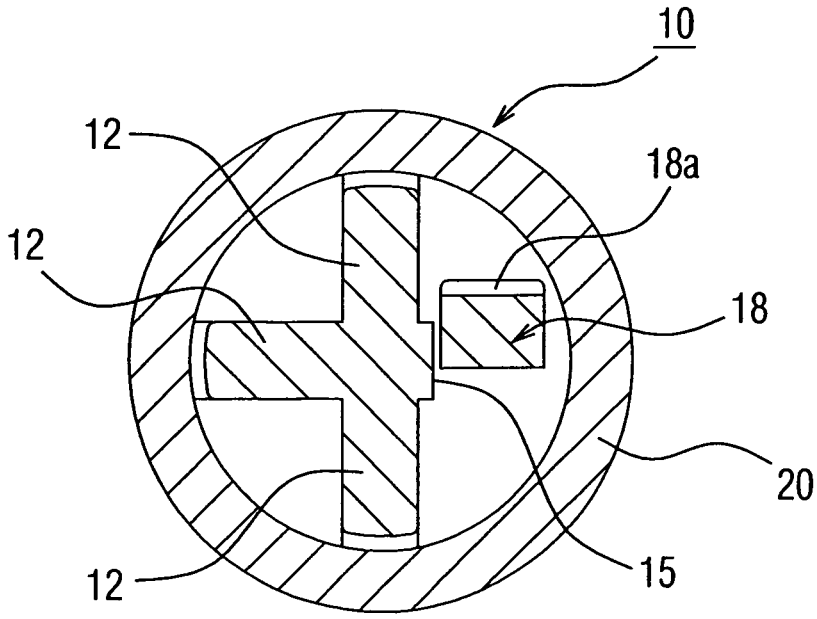
FIG. 3 is a sectional view taken along the along lines III-III of the screw holding type screwdriver bit shown in FIG. 1.
Figure 4:
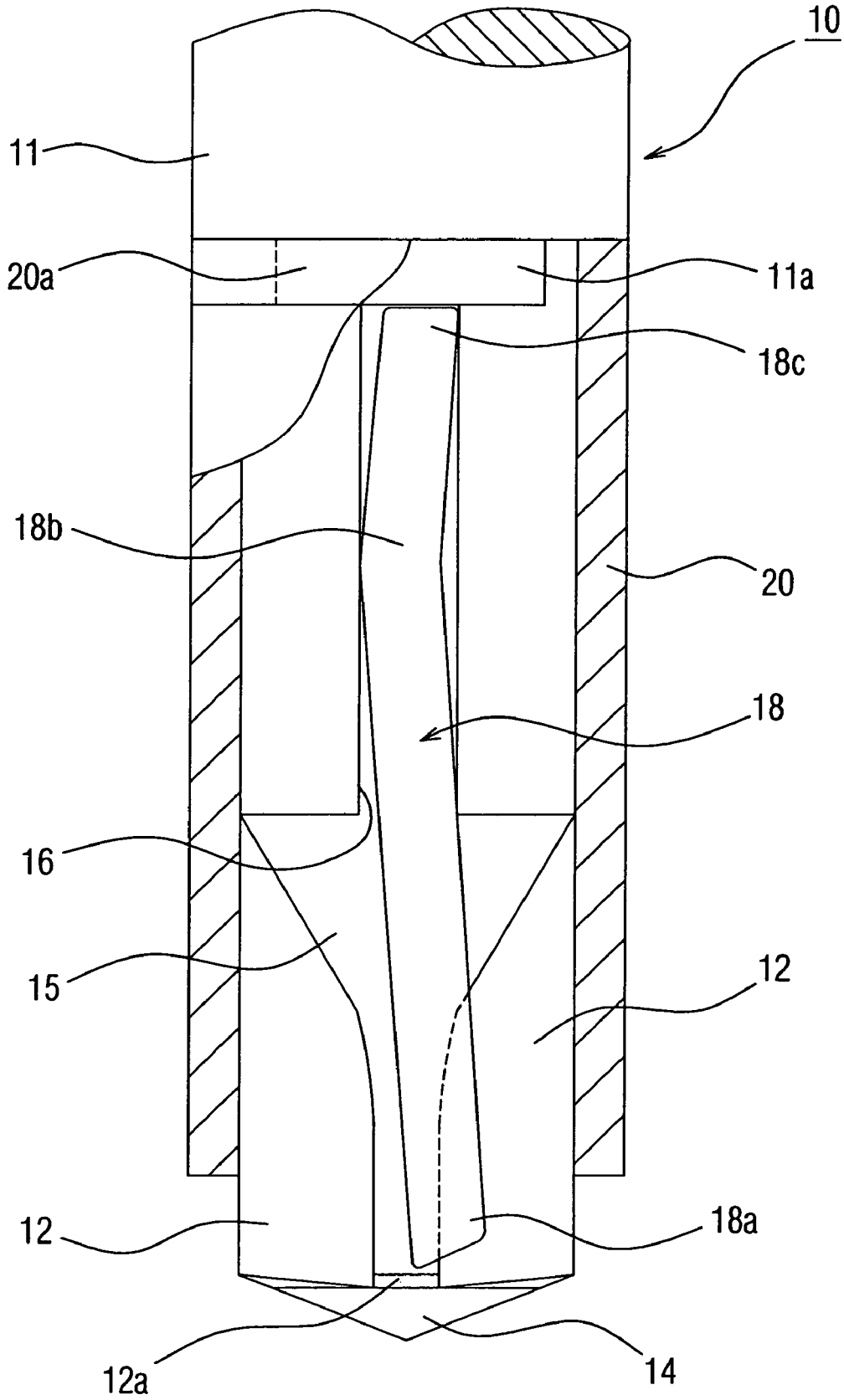
FIG. 4 is a sectional side view of the essential portion seen from the right side surface of the screw holding type screwdriver bit shown in FIG. 1.

In this structure, the tip end 18*a* of the elastic piece 18 that has the screw holding function is inserted and disposed inside the long groove 16 so that the tip end 18*a* is offset in the circumferential direction with respect to the flat blade portions 12 whose tip ends 12*a* are cut out (see FIGS. 2 through 4). Accordingly, the long groove 16 is formed so that this groove has a width that is slightly greater than the thickness of the flat blade portion that is cut out, and the elastic piece 18 that has the screw holding function is inserted and disposed while being partially bent in the circumferential direction of the shaft portion 11 (see FIG. 4). By the use of this structure, the elastic piece 18 can maintain itself inside the long groove 16 by its bending elastic force; and the tip end 18*a* of the elastic piece 18 can be positioned so as to be offset from the position of the flat blade portion that is cut out. More specifically, in the shown example, the elastic piece 18 that is inserted in the long groove 16 is bent at one part 18*b* thereof; as a result, the tip end 18*a* of the elastic piece 18 that has a screw holding function is set so that the tip end 18*a* is offset to the rear in the direction of rotation (toward the side wall 33*b* of the bit engagement groove 32) with respect to the direction of screw tightening rotation of the screwdriver bit 10.

In FIG. 6, the bit engagement groove 32 of the screw 30 in this embodiment is formed with an opening dimension m based upon JIS (Japan Industrial Standards) which is known conventionally. More specifically, a substantially perpendicular end wall 33*a* and two side wall 33*b*, 33*b* that have a draft angle of approximately 1.5 to 5° (draft angle γ of the header punch) are respectively formed to a specified depth from the opening end edge 32*a* of the bit engagement groove 32, and a circular conical bottom surface 35 with an inclination angle α of approximately 25° to 35° is formed toward the center of the neck 30*b* from the lower edge 32*a*' of the end walls 33 via a slight substantially horizontal step portion 34.

Next, the coupling operation between the screw holding type screwdriver bit of the embodiment described above (see FIG. 4) and the screw 30 (see FIG. 6) that is used with this screwdriver bit will be described.

FIGS. 5 and 6 show the coupled state of the screw 30 and the screw holding type screwdriver bit 10 shown in FIG. 4. More specifically, FIG. 5 shows a state in which the tip ends of the flat blade portions 12 and the tip end of the elastic piece 18 of the screw holding type screwdriver bit 10 are respectively engaged with the bit engagement groove 32 formed in the head 30*a* of the screw 30. In this case, the tip end of the elastic piece 18 elastically contacts the side wall 33*b* of the bit engagement groove 32 on the rear side of rotation with respect to the tightening rotational direction R of the screw holding type screwdriver bit 10. As a result, the elastic piece 18 that elastically contacts the side wall 33*b* of the bit engagement groove 32 of the head 30*a* can effectively manifest a screw holding function as a result of interaction with the flat blade portions 12 of the screw holding type screwdriver bit 10 that engage with the bit engagement groove 32.

In this embodiment, furthermore, upon coupling the screw 30 and the screw holding type screwdriver bit 10 together as shown in FIG. 5, when the tip ends of the flat blade portions 12 are engaged with the bit engagement groove 32 of the head 30*a* as shown in FIG. 6, the tip end 18*a* of the elastic piece 18 contacts the opening end edge 32*a* of the bit engagement groove 32 as shown by broken lines. Accordingly, as a result of the screw holding type screwdriver bit 10 being pushed from above, the tip end 18*a* of the elastic piece 18 engages with the bit engagement groove 32 as shown by solid lines, while being elastically displaced. As a result, the tip end 18*a* of the elastic piece 18 engaged with the bit engagement groove 32 elastically contacts the side wall 33*b* of the bit engagement groove 32. Accordingly, it is preferable to form the tip end 18*a* of the elastic piece 18 into an inclined surface as shown in FIG. 6 so that a smooth engagement of the tip end 18*a* of the elastic piece 18 with the bit engagement groove 32 can be made.

Embodiment 2

Figure 7:
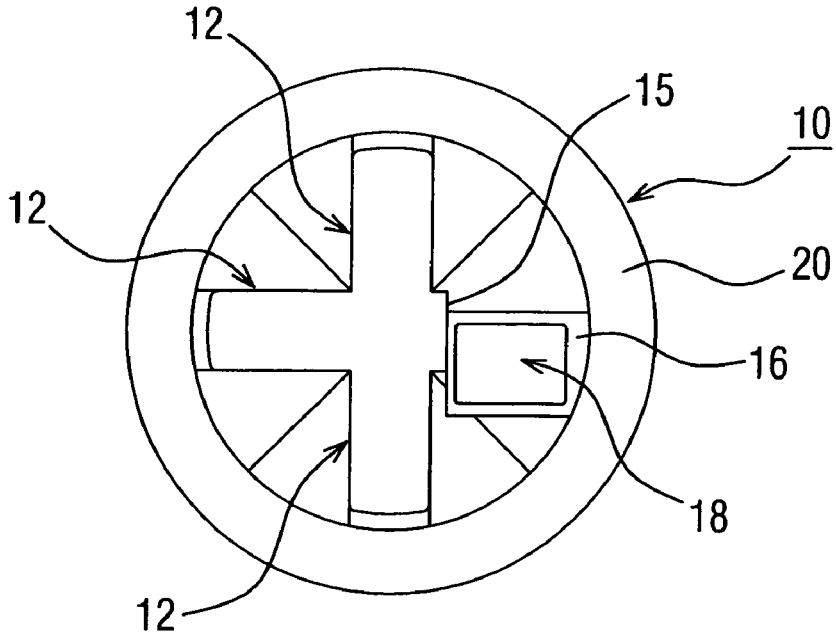
FIG. 7 is an end view showing the bit tip end of a modification of the screw holding type screwdriver bit of the present invention.
Figure 8:
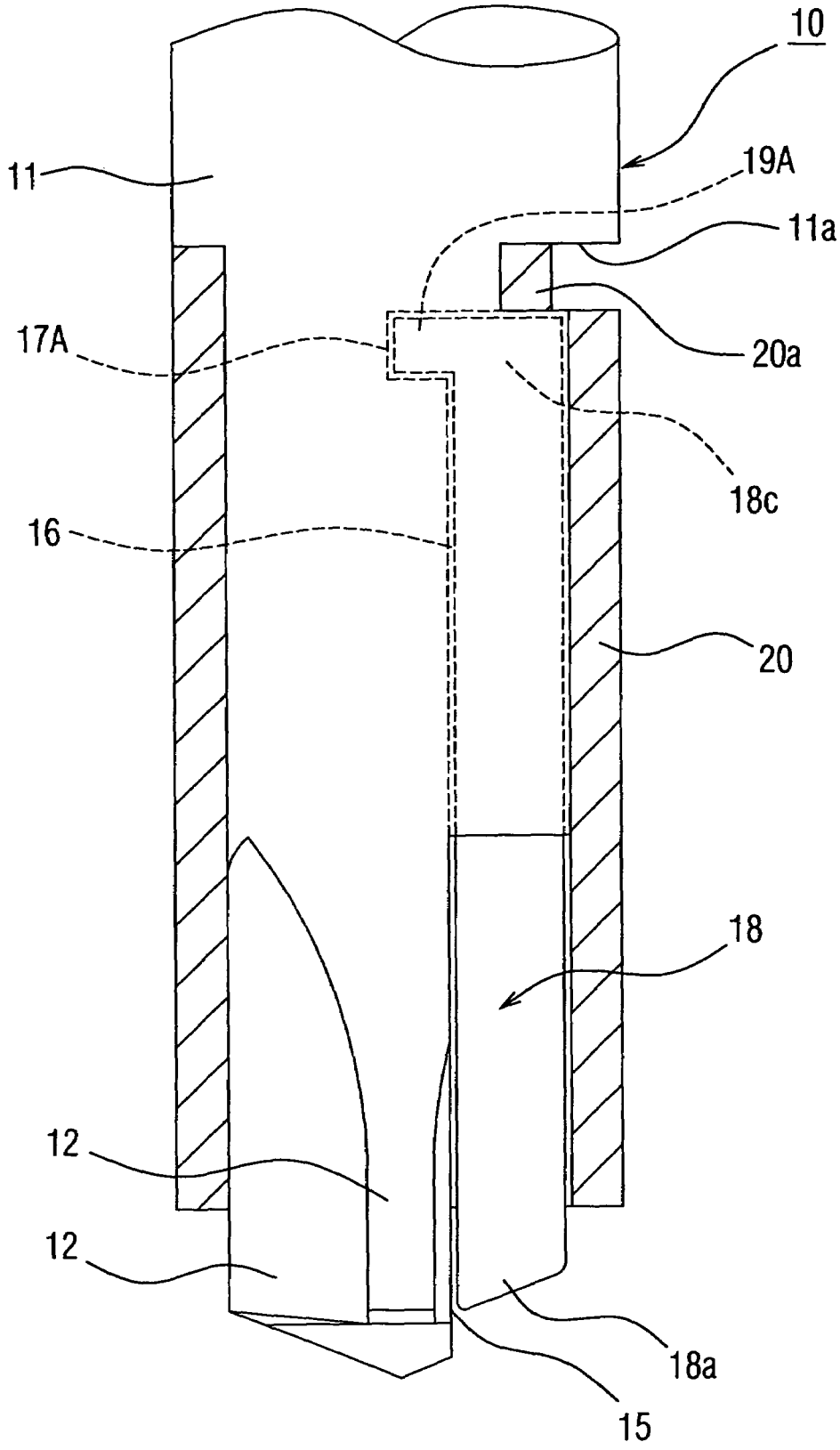
FIG. 8 is a sectional side view of the essential portion of the screw holding type screwdriver bit shown in FIG. 7.

FIGS. 7 and 8 show a modification of the above-described embodiment of the screw holding type screwdriver bit of the present invention. More specifically, in this embodiment, a structure is used in which the long groove 16 disposed in the screw holding type screwdriver bit 10 is set at a width that is substantially equal to that of the flat blade portion that is cut out, and this long groove 16 is formed in a position that is offset in the circumferential direction with respect to this flat blade portion. The elastic piece 18 that has the screw holding function is not bent, and the rear end 18*c* of this elastic piece 18 is inserted and disposed so that this rear end 18*c* is anchored inside the long groove 16. In this case, an anchoring recess 17 is formed in the rear end 16*a* of the long groove 16 of the shaft portion 11, and an anchoring projection 19A that engages with the anchoring recess 17A is disposed on the rear end 18*c* of the elastic piece 18. The remaining structure is the same as that of the screw holding type screwdriver bit 10 described in the Embodiment 1.

In the screw holding type screwdriver bit 10 of this embodiment, which is constructed in this manner, the tip end 18*a* of the elastic piece 18 that is inserted and disposed inside the long groove 16 of the screw holding type screwdriver bit 10 is offset in the circumferential direction with respect to the position of the flat blade portion that is cut out. Accordingly, as in the case of Embodiment 1 shown in FIGS. 5 and 6, the holding of the screw 30 by the screw holding type screwdriver bit 10 can be securely accomplished, and a smooth screw tightening operation can easily be achieved.

Embodiment 3

Figure 9:
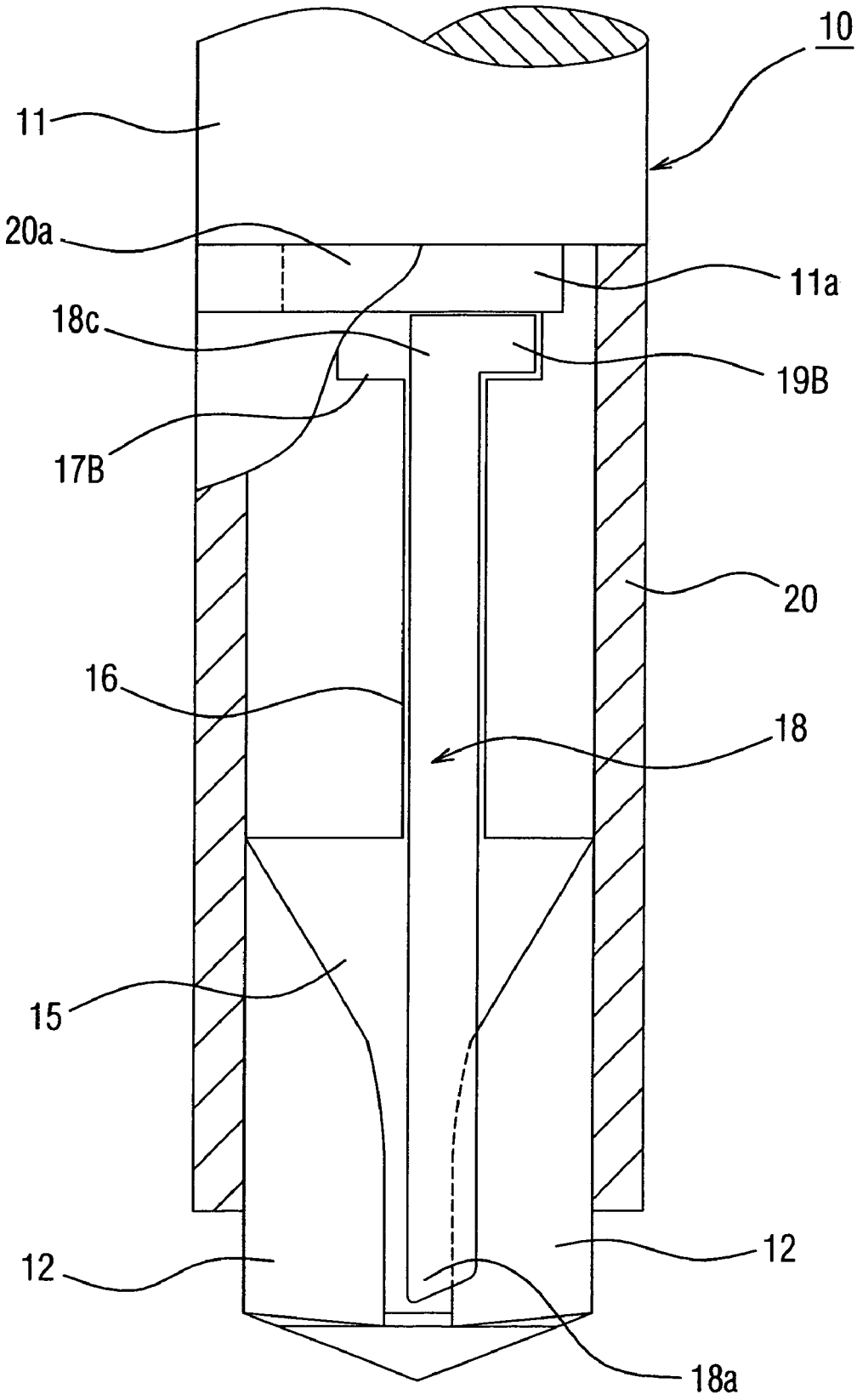
FIG. 9 is a sectional side view of still another modification of the screw holding type screwdriver bit shown in FIG. 8.

FIG. 9 shows a modification of Embodiment 2 of the screw holding type screwdriver bit of the present invention. More specifically, this embodiment takes a structure in which an anchoring groove 17B is disposed in a direction perpendicular to the long groove 16 of the screw holding type screwdriver bit 10 in the rear end 16*a* of the long groove 16 of the shaft portion 11 as a means of anchoring the rear end 18*c* of the elastic piece 18 that has a screw holding function inside this long groove 16, and an anchoring projection 19B that engages with the anchoring groove 17B is formed on the rear end 18*c* of the elastic piece 18. Accordingly, in the screw holding type screwdriver bit 10 of this embodiment constructed as described above, the holding of the screw 30 by the screw holding type screwdriver bit 10 can be securely accomplished, and a smooth screw tightening operation can easily be achieved, in exactly the same manner as in the Embodiment 2.

Embodiment 4

Figure 10:
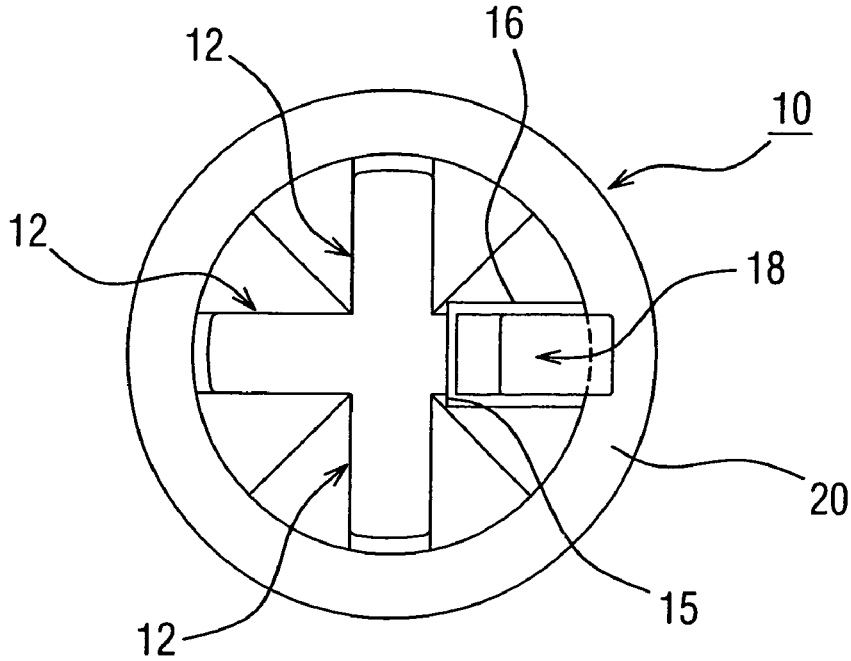
FIG. 10 is an end view showing the bit tip end of another embodiment of the screw holding type screwdriver bit of the present invention.
Figure 11:
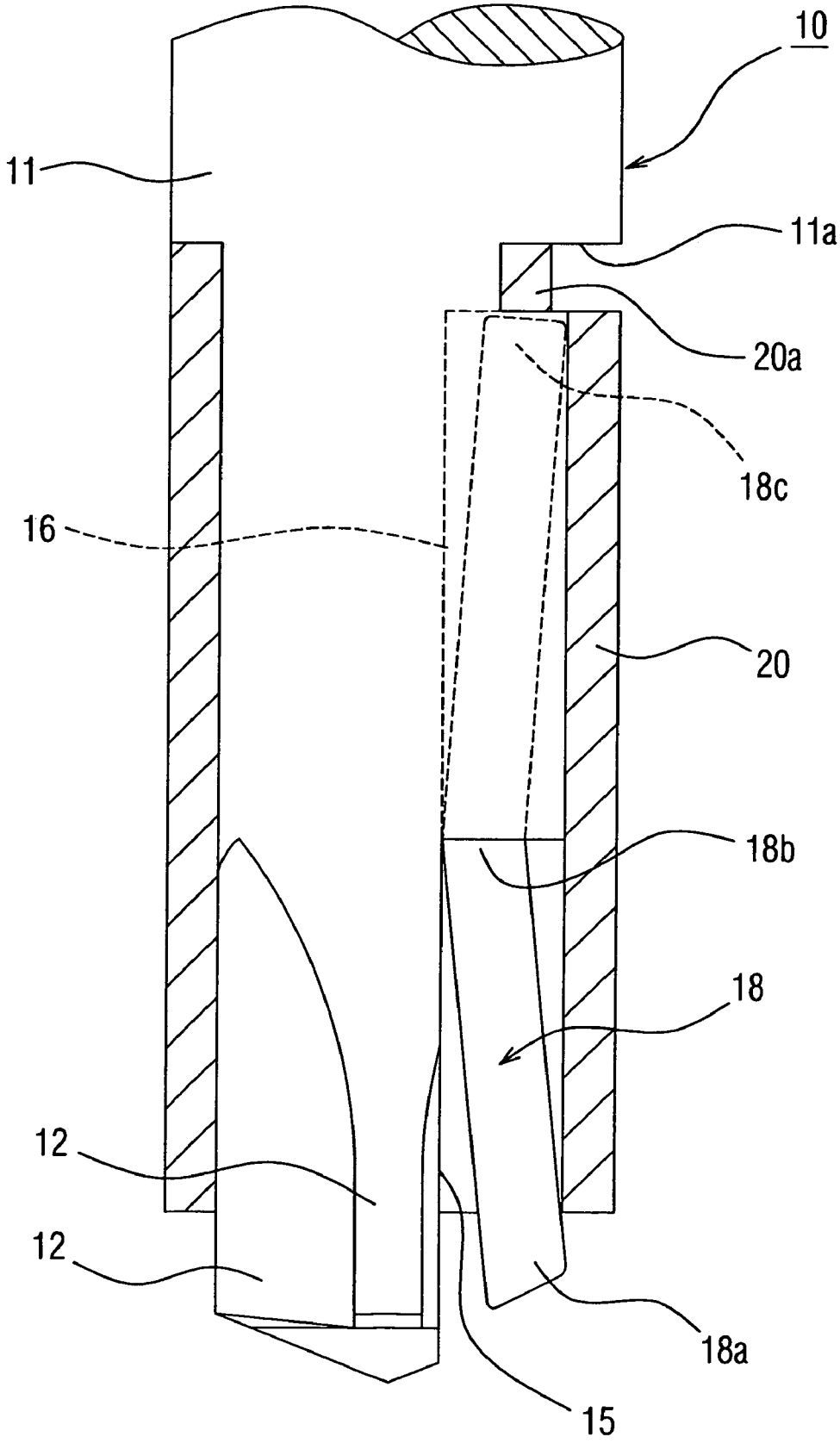
FIG. 11 is a sectional side view of the essential portion of the screw holding type screwdriver bit shown in FIG. 10.

FIGS. 10 and 11 show another embodiment of the screw holding type screwdriver bit of the present invention. More specifically, this embodiment takes a structure in which the tip end 18*a* of the elastic piece 18 that has a screw holding function is inserted and disposed inside the long groove 16 so that the tip end 18*a* is offset outward in the radial direction with respect to the flat blade portion that is cut out. In this case, the long groove 16 has a width that is substantially equal to or slightly greater than the thickness of the flat blade portion that is cut out, and the elastic piece 18 that has a screw holding function is inserted and disposed in the long groove 16 while being partially bent in the radial direction of the shaft portion 11. More specifically, in the shown example, the elastic piece 18 that is in the long groove 16 is bent at one part 18*b* thereof; as a result, the tip end 18*a* of the elastic piece 18 that has a screw holding function is set so that the tip end is offset outward in the radial direction (toward the side wall 33*b* of the bit engagement groove 32) with respect to the flat blade portion 12.

Accordingly, in the screw holding type screwdriver bit 10 of this embodiment constructed as described above, since the tip end 18*a* of the elastic piece 18 that is inserted and disposed in the long groove 16 of the screw holding type screwdriver bit 10 is offset outward in the radial direction with respect to the position of the flat blade portion that is cut out, the tip end 18*a* elastically contacts the side wall 33*a* of the bit engagement groove 32. As a result, the elastic piece 18 that elastically contacts the end wall 33*a* of the bit engagement groove 32 of the head 30*a* can effectively manifest a screw holding function as a result of the interaction with the flat blade portions 12 of the screw holding type screwdriver bit 10 that are engaged with the bit engagement groove 32.

Embodiment 5

Figure 12:
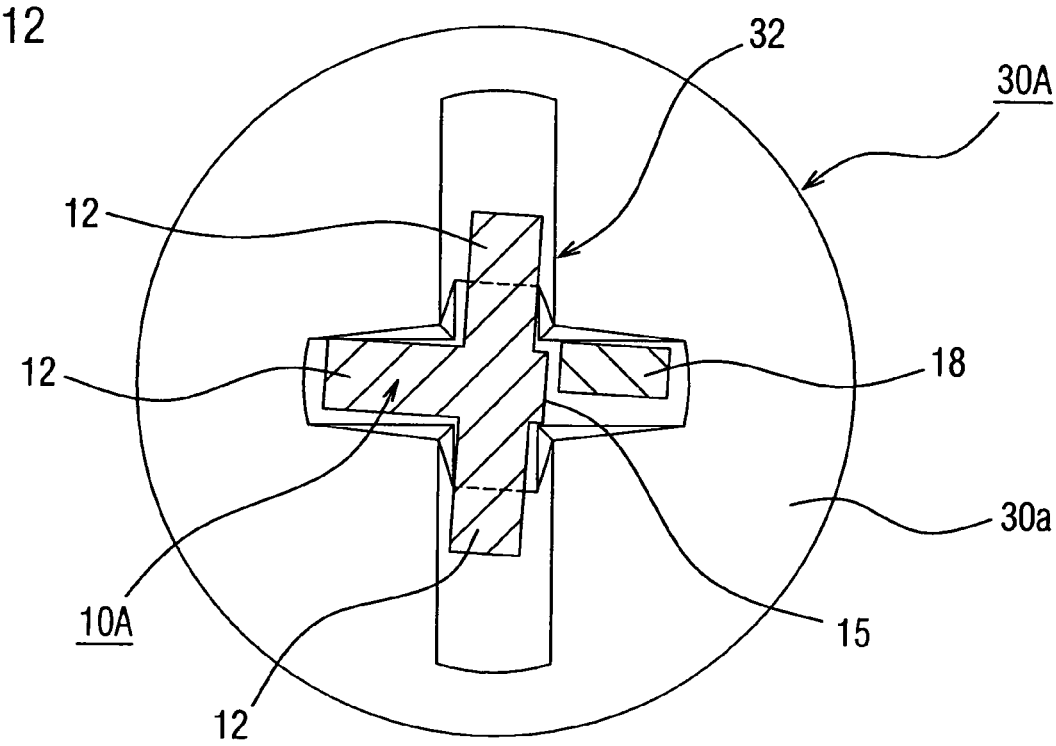
FIG. 12 shows another embodiment of a screw used with the screw holding type screwdriver bit of the present invention, being a sectional plan view of the essential portion of the head of a screw in a state in which the screw is held by the screw holding type screwdriver bit.

FIG. 12 shows another embodiment of a screw that is used with the screw holding type screwdriver bit of the present invention. More specifically, this embodiment comprises a combination of the screw holding type screwdriver bit 10A of Embodiment 1 and a plus-minus screw 30A in which one rectilinear groove that crosses the bit engagement groove 32 of the screw 30 of Embodiment 1 is constructed as the bit engagement groove 32 of the head 30*a* so that engagement with a minus screwdriver bit can be made. FIG. 12 is a sectional plan view that shows the essential portion of the head of the plus-minus screw 30A wherein the screw is held by the screw holding type screwdriver bit 10A illustrated in the same manner as in FIG. 5.

In this combination of the screw holding type screwdriver bit 10A of this embodiment constructed as described above and the plus-minus screw 30A, the screw can be securely held as shown in the drawings, and a smooth screw tightening operation can easily be achieved.

Embodiment 6

Figure 13:
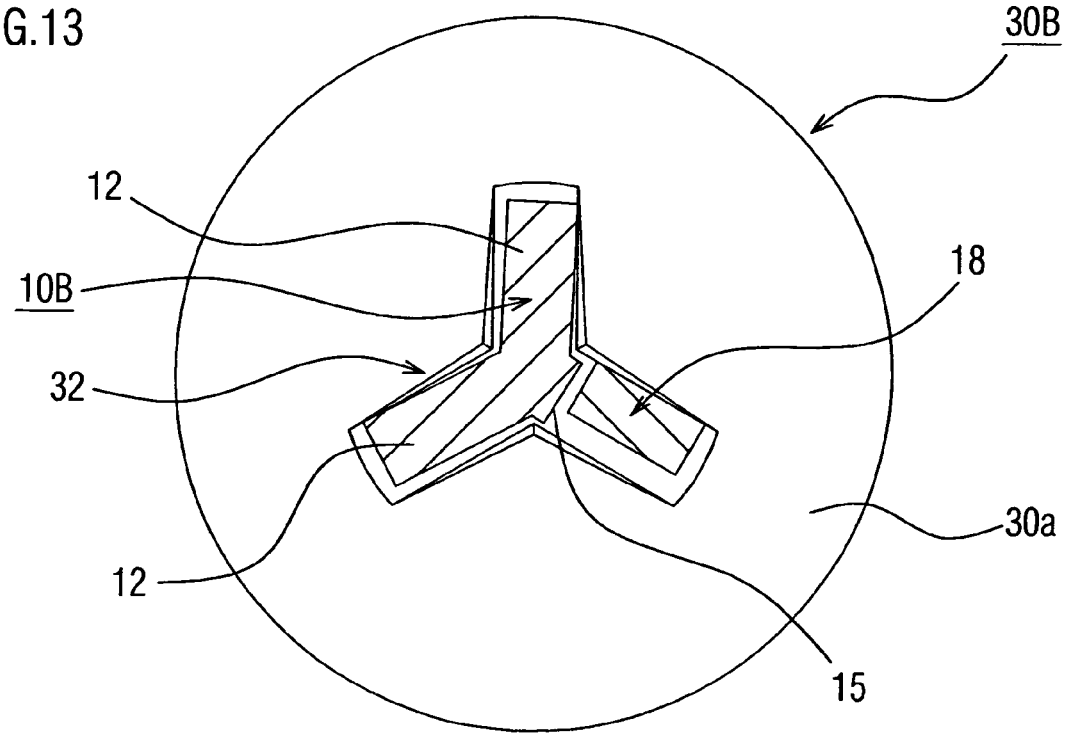
FIG. 13 shows another embodiment of the screw holding type screwdriver bit of the present invention and a screw used with this screw holding type screwdriver bit, being a sectional plan view of the essential portion of the head of a screw in a state in which the screw is held by the screw holding type screwdriver bit.

FIG. 13 shows another embodiment of the screw holding type screwdriver bit of the present invention and a screw that can be used with this screw holding type screwdriver bit. This embodiment is for a combination of a screw 30B, in which a three-way groove that branches in three directions from the center of the head 30*a* is constructed as the bit engagement groove 32 of the head 30*a*, and a screw holding type screwdriver bit 10B, which is provided with flat blade portions 12 that fit in the bit engagement groove 32 of this screw 30B. In the screw holding type screwdriver bit 10B of this embodiment, as in the screw holding type screwdriver bit 10 of the above-described embodiment, one of the flat blade portions 12 is cut out in the axial direction of the bit; a long groove 16 of a specified length is formed in a part of the shaft portion 11 that is substantially on an extension of the cut-away portion 15, where a flat blade portion is cut out, from this corner portion; and an elastic piece 18, which elastically contacts the bit engagement groove 32 of the head 30*a* and has a screw holding function as a result of interaction with the flat blade portions 12 that are inserted into the engagement groove 32, is inserted and disposed inside the long groove 16.

In this combination of the screw holding type screwdriver bit 10B of this embodiment constructed as described above and the screw 30B, the screw can be securely held as shown in FIG. 13, and a smooth screw tightening operation is easily achieved.

Embodiment 7

Figure 14:
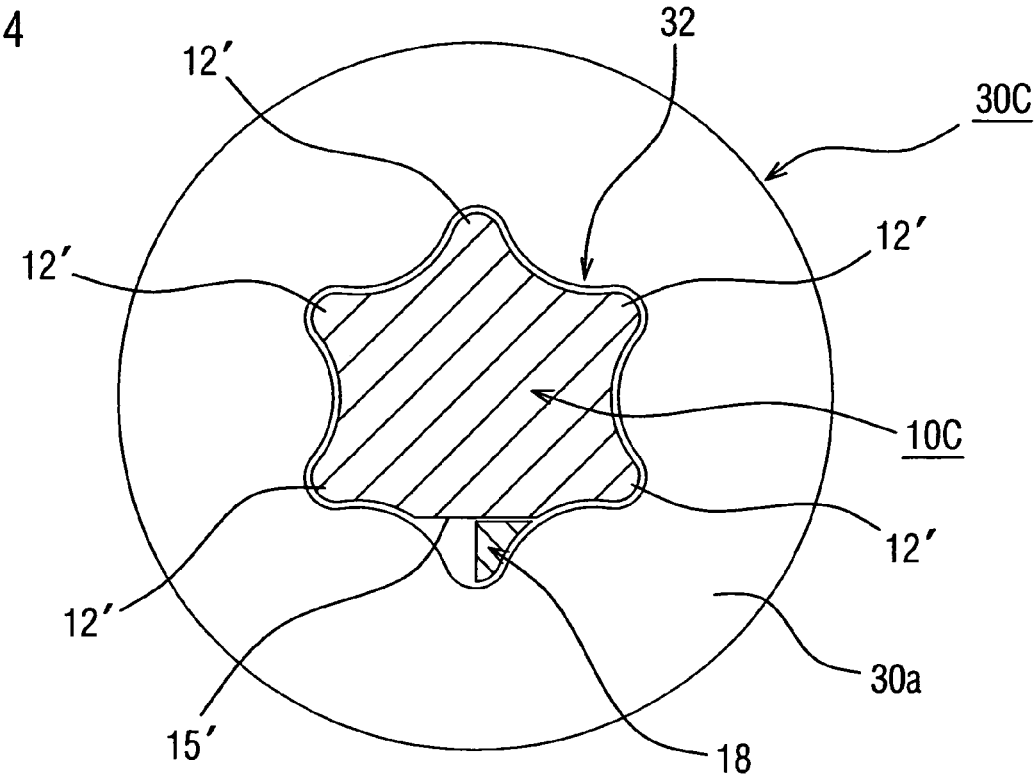
FIG. 14 shows still another embodiment of the screw holding type screwdriver bit of the present invention and a screw used with this screw holding type screwdriver bit, being a sectional plan view of the essential portion of the head of a screw in a state in which the screw is held by the screw holding type screwdriver bit.

FIG. 14 shows still another embodiment of the screw holding type screwdriver bit of the present invention and a screw that is used with this screwdriver bit. This embodiment includes a screw 30C, which has a modified hexagonal hole formed as the bit engagement groove 32 of the head 30*a*, and a screw holding type screwdriver bit 10C, which has corner portions 12' with a modified hexagonal shape so as to fit the bit engagement groove 32 of this screw 30C. Accordingly, in the screw holding type screwdriver bit 10C of this embodiment, as in the screw holding type screwdriver bit 10 of the above-described embodiment, one of the corner portions 12' of the modified hexagonal shape is cut out in the axial direction of the bit; a long groove 16 of a specified length is formed in a part of the shaft portion 11 that is substantially on an extension line of the cut-away portion 15' where a corner portion is cut out; and an elastic piece 18, which elastically contacts the bit engagement groove 32 of the head 30*a* and has a screw holding function as a result of interaction with the corner portions 12' of the modified hexagonal shape that are inserted into the engagement groove 32, is inserted and disposed inside the long groove 16.

In this combination of the screw holding type screwdriver bit 10C of this embodiment constructed as described above and the screw 30C, the screw can be securely held as shown in FIG. 14, and a smooth screw tightening operation can easily be achieved.

Embodiment 8

Figure 15:
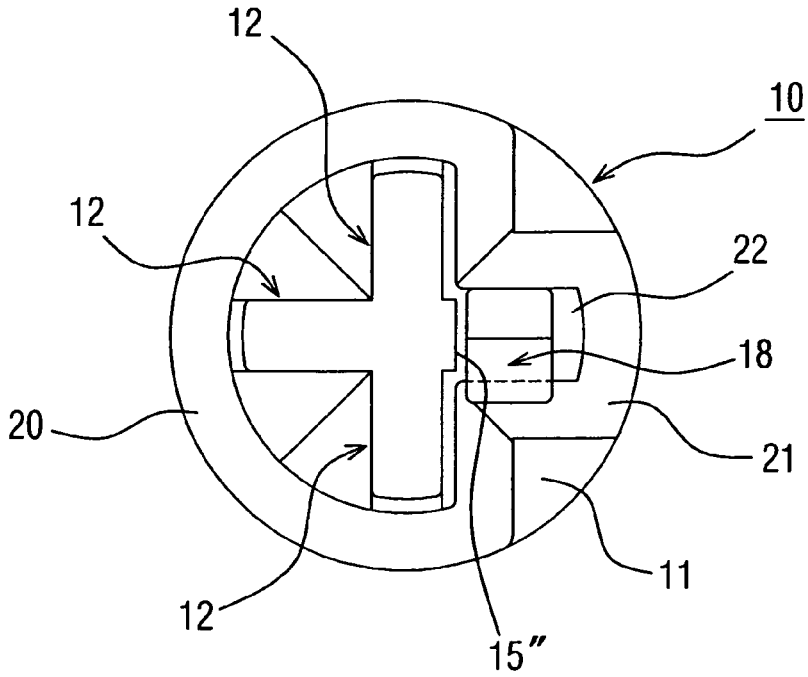
FIG. 15 is an end view of the bit tip end showing another embodiment of the guide passage in which the elastic piece of the screw holding type screwdriver bit of the present invention is inserted and disposed.

FIG. 15 shows another embodiment of the guide passage in which the elastic piece 18 of the screw holding type screwdriver bit 10 of the present invention is inserted and disposed. More specifically, in this embodiment, upon assembly of the screw holding type screwdriver bit 10 of Embodiment 1, one of the flat blade portions 12 and a part of the shaft portion 11 located on an extension of this flat blade portion 12 are cut out in the axial direction of the bit, and a guide passage 22 which is used to insert and dispose an elastic piece 18 that elastically contacts the bit engagement groove 32 of the head 30*a* and has a screw holding function as a result of interaction with the flat blade portions 12 that are inserted into the bit engagement groove 32 (with respect to the cut-away portion 15" of the flat blade portion and the shaft portion 11 that constitutes a continuation of this flat blade portion) is constructed by a bent portion 21 which is formed in the protective sleeve 20 that is provided on the outer circumference of the shaft portion 11 so as to surround the flat blade portions 12 and elastic piece 18.

As a result of the guide passage 22 used to insert and dispose the elastic piece 18 thus constructed, the attachment of the elastic piece 18 having a screw holding function can be accomplished in a simple manner.

Embodiment 9

Figure 16:
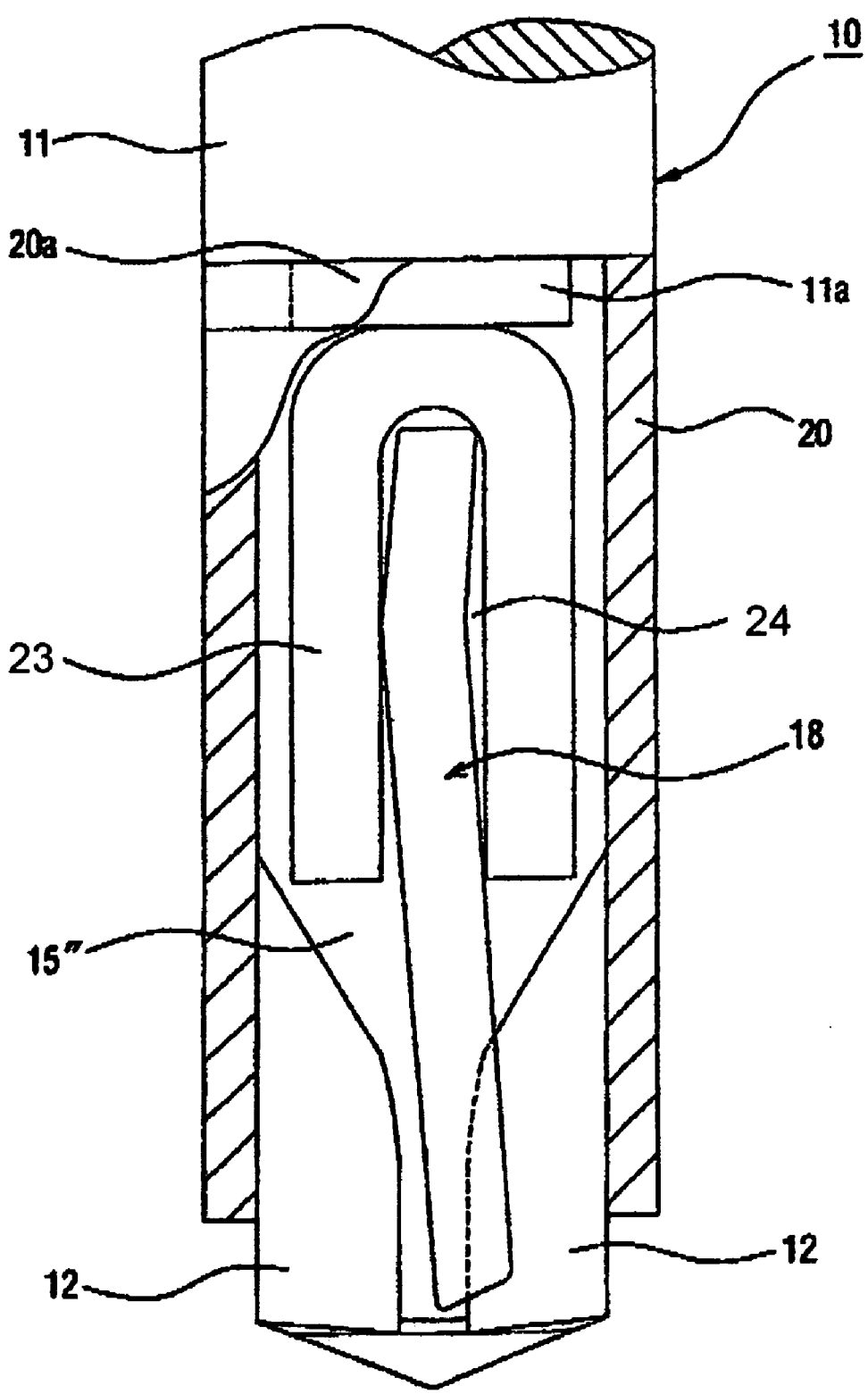
FIG. 16 is an end view showing the bit tip end of still another embodiment of the guide passage in which the elastic piece of the screw holding type screwdriver bit of the present invention is inserted and disposed.
Figure 17:
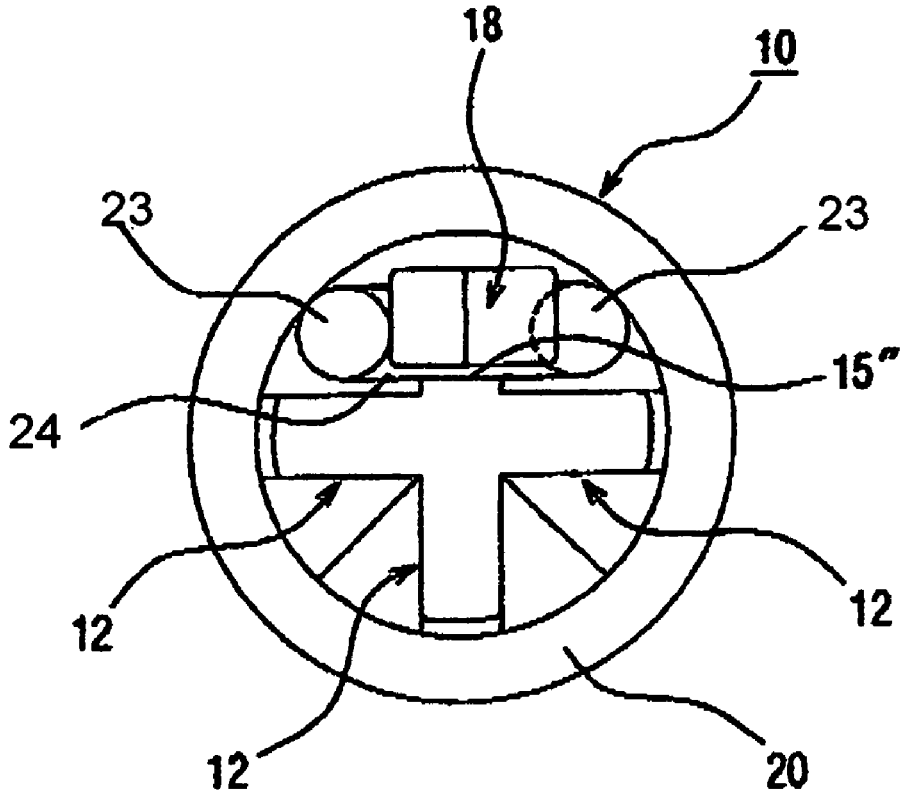
FIG. 17 is an end view of the bit tip end of the screw holding type screwdriver bit shown in FIG. 16.

FIGS. 16 and 17 show still another embodiment of the guide passage in which the elastic piece of the screw holding type screwdriver bit of the present invention is inserted and disposed. In this embodiment, prior to the assembly of the screw holding type screwdriver bit 10 of Embodiment 1, one of the flat blade portions 12 and a part of the shaft portion 11 located on an extension of this flat blade portion 12 are cut out in the axial direction of the bit; and a guide passage 24, which is used to insert and dispose an elastic piece 18 that elastically contacts the bit engagement groove 32 of the head 30*a* and has a screw holding function as a result of interaction with the flat blade portions 12 that are inserted into the bit engagement groove 32, is constructed by an elastic piece holding pin 23 of an inverted U shape provided in the cut-away portion 15" of the flat blade portion 12 and shaft portion 11 that forms a continuation of this flat blade portion.

The attachment of the elastic piece 18 having a screw holding function can also be simply achieved by thus forming the guide passage 24 in which the elastic piece 18 is inserted and disposed.

Embodiment 10

Figure 18:
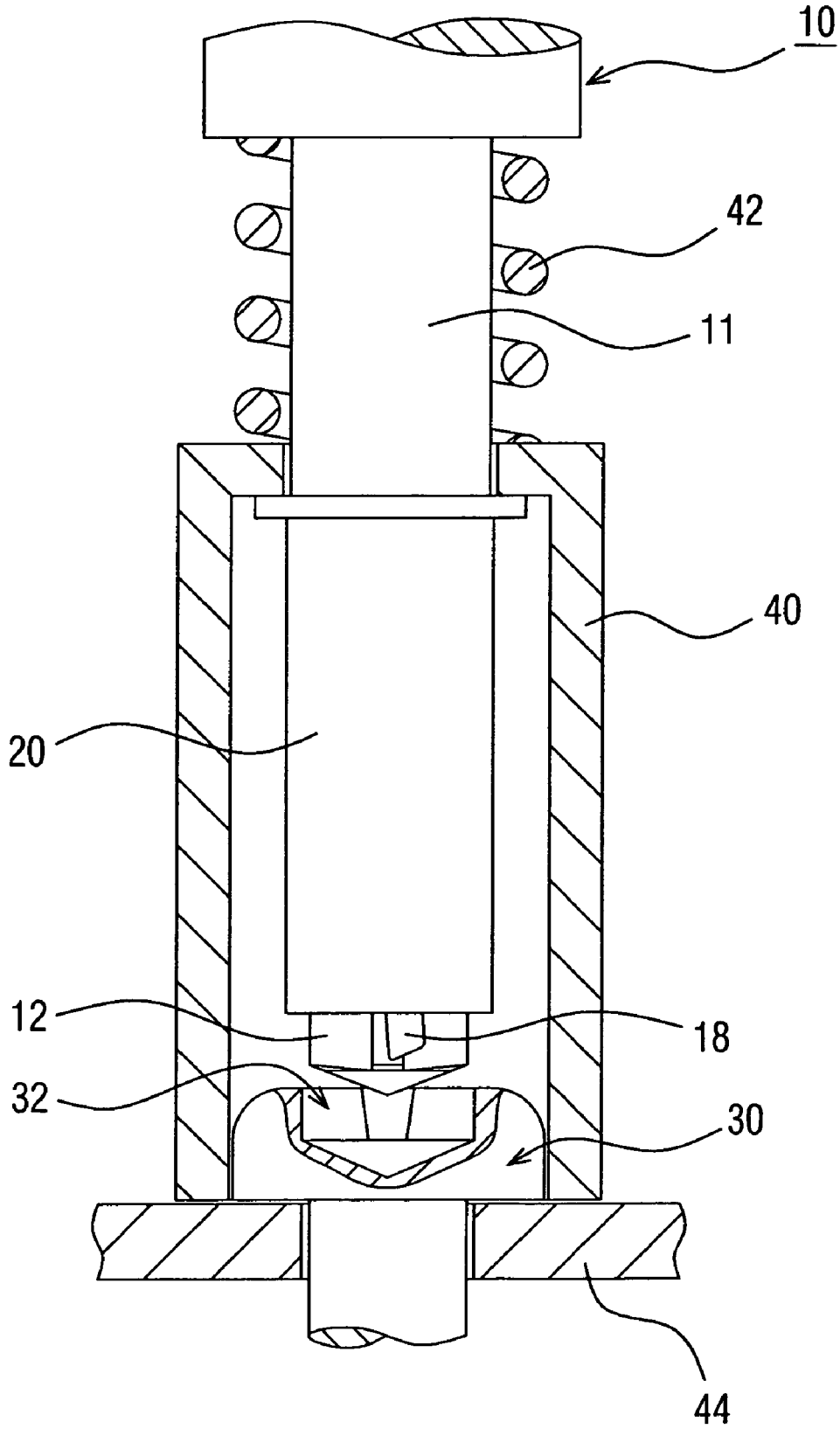
FIG. 18 is a sectional side view showing the essential portion of still another embodiment of the screw holding type screwdriver bit of the present invention.

FIG. 18 shows still another embodiment of the screw holding type screwdriver bit of the present invention. More specifically, this embodiment takes a structure in which a screw protecting sleeve 40 that surrounds the head 30*a* of the screw 30, which is held by the flat blade portions 12 and elastic piece 18, is provided on the outer circumference of the shaft portion 11, which has the elastic piece 18 that has a screw holding function and is inserted and disposed inside the long groove 16, so that the screw protecting sleeve 40 is elastically movable in the axial direction of the bit by a coil spring 42.

Accordingly, in the screw holding type screwdriver bit 10 of this embodiment constructed as described above, as shown in FIG. 18, the tip ends 12*a* of the flat blade portions 12 and the tip end 18*a* of the elastic piece 18 of the screw holding type screwdriver bit 10 can be smoothly and securely engaged with the bit engagement groove 32 of a screw, so that a screw holding operation can be quickly achieved so that the head 30*a* is positioned and held by the screw protecting sleeve 40 by the tip end of the screw protecting sleeve 40 making a pressing contact from above with a desired screw 30 among numerous screws that are suspended in rows on a screw base 44. Furthermore, in cases where a screw that is thus held is to be moved to a desired object of screw attachment following such a screw holding operation, the screw 30 held by the tip ends 12*a* of the flat blade portions 12 and by the tip end 18*a* of the elastic piece 18 of the screw holding type screwdriver bit 10 is surrounded and held by the screw protecting sleeve 40 and thus can be safely and securely moved to an object of screw attachment.

Though the preferred embodiments of the present invention are respectively described above, the present invention is not limited to the above embodiments. For example, in regard to the shape and dimensions of the elastic piece, and the structure of the guide passage in which the elastic piece is inserted and disposed, etc., various structures and manners can be employed; and it goes without saying that numerous design alterations can be made within the limit that involves no departure from the spirit of the present invention.

(Merits of the Invention)

As is clear from the above-described embodiments, the screw holding type screwdriver bit of the present invention has a structure in which a plurality of flat blade portions in which substantially perpendicular end edge portions are formed on the tip ends are provided; the central portions of the tip ends of these flat blade portions are formed into a circular conical projection; a part of one of the flat blade portions is cut out in the bit axial direction of the screwdriver bit; a long groove which has a specified length and is formed in a part of the shaft portion of the screwdriver bit so that the long groove is located on a line that is substantially an extension of the cut-out of the flat blade portion; and an elastic piece, which elastically contacts the bit engagement groove of the head and has a screw holding function as a result of interaction with the flat blade portions inserted in the bit engagement groove, is inserted and disposed in the long groove. As a result, a screw holding type screwdriver bit, which is free of the "come-out" phenomenon, has a simple structure and can be manufactured at low cost, assures a quick and suitable screw tightening work, and improves the working efficiency conspicuously, is provided.

Furthermore, the screw holding type screwdriver bit of the present invention has a relatively simple structure in which one of the flat blade portions of the screwdriver bit is cut out, a long groove of a specified length is formed, and an elastic piece with a screw holding function is inserted and disposed in this long groove. Accordingly, manufacture and maintenance are easy. Moreover, when holding a screw, only the pressing contact elastic force of the elastic piece is utilized by engaging the flat blade portions at the tip end of the screwdriver bit with the screw head; accordingly, a secure and stable screw holding function is manifested without any need for a combined use of a magnet or suction force by air, etc. as in the conventional devices.

Furthermore, in the combination of the screw holding type screwdriver bit and screw provided by the present invention, a secure screw holding function is manifested by making a direct engagement of the flat blade portions and elastic piece of the screwdriver bit with the bit engagement groove of the screw. Accordingly, the rotational force of the screwdriver bit can be smoothly transmitted to the screw without any "come-out" phenomenon or damage to the screw, etc., so that a screw tightening operation can always be quickly performed at an appropriate torque. Furthermore, a secure screw tightening operation can always be performed by an appropriate torque on objects of screw attachment that are made of various types of hard and soft materials, damage to the screws can be greatly reduced, and an improvement in the safety and working efficiency of the screw tightening work can be easily and economically achieved.

The invention claimed is:

1. A screw holding type screwdriver bit having, at a tip end of a shaft portion thereof, a plurality of blade portions formed with a substantially perpendicular end edge portion at a tip end of each one of said plurality of blade portions, said screwdriver bit being for a screw having a bit engagement groove of a shape selected from the group consisting of cross, a three way form and polygon, wherein said screwdriver bit comprises:

a cut out portion formed by cutting out one of said plurality of blade portions in a direction of an axis of said screwdriver bit;

a guide passage formed by cutting out a part of said shaft portion of said screwdriver bit for a predetermined length extending from said cut out portion;

a protective sleeve provided on and so as to surround an outer circumference of said shaft portion, in which said guide passage is formed, with tip ends of said blade portions partially exposed; and an elastic piece inserted and disposed between said guide passage extending from said cut out portion and said protective sleeve so that a tip end of said elastic piece, together with said blade portions, is exposed from said protective sleeve and said elastic piece is offset in a circumferential direction with respect to said cut out portion, and wherein said guide passage has a width slightly greater than a thickness of said one of said plurality of blade portions which is cut out, and said elastic piece is inserted and disposed in said guide passage with a part of said elastic member bent in a circumferential direction of said shaft portion;

said protective sleeve is fastened, by crimping, at a mounting end thereof to a cut-out formed on an outer circumference of said shaft portion, and a rear end of said elastic piece is contacted to and engaged with an inside of said mounting end of said protective sleeve; and the tip end of said elastic piece, when engaged with a bit engagement groove of said screw by an elastic force that acts in a direction opposite from a screw tightening direction of said screw, holds said screw.

2. The screw holding type screwdriver according to claim 1, wherein said elastic piece is, at a rear end thereof, contacted to and engaged with an inside of said crimping-fastened rear end of said protective sleeve, and said elastic piece is formed with an anchoring projection that engages with an anchoring groove formed, corresponding to said rear end of said elastic piece, in a direction perpendicular to said guide passage.

3. A screw holding type screwdriver bit having, at a tip end of a shaft portion thereof, a plurality of blade portions formed with a substantially perpendicular end edge portion at a tip end of each one of said plurality of blade portions, said screwdriver bit being for a screw having a bit engagement groove of a shape selected from the group consisting of cross, a three way form and polygon, wherein said screwdriver bit comprises:

a cut out portion formed by cutting out one of said plurality of blade portions in a direction of an axis of said screwdriver bit;

a guide passage formed by cutting out a part of said shaft portion of said screwdriver bit for a predetermined length extending from said cut out portion;

a protective sleeve provided on and so as to surround an outer circumference of said shaft portion, in which said guide passage is formed, with tip ends of said blade portions partially exposed; and an elastic piece inserted and disposed between said guide passage extending from said cut out portion and said protective sleeve so that a tip end of said elastic piece, together with said blade portions, is exposed from said protective sleeve and said elastic piece is offset in a circumferential direction with respect to said cut out portion, and wherein said guide passage has a width substantially equal to a thickness of said one of said plurality of blade portions which is cut out, and said guide passage is formed so as to be offset with respect to a circumferential direction of a position of said one of said plurality of blade portions which is cut out so that said elastic piece is inserted and disposed in said guide passage with said elastic member unbent;

said protective sleeve is fastened, by crimping, at a mounting end thereof to a cut-out formed on an outer circumference of said shaft portion, and a rear end of said elastic piece is contacted to and engaged with an inside of said mounting end of said protective sleeve; and the tip end of said elastic piece, when engaged with a bit engagement groove of said screw by an elastic force that acts in a direction opposite from a screw tightening direction of said screw, holds said screw.

4. The screw holding type screwdriver according to claim 3, wherein said elastic piece is, at a rear end thereof, contacted to and engaged with an inside of said crimping-fastened rear end of said protective sleeve, and said elastic piece is formed with an anchoring projection that engages with an anchoring groove formed, corresponding to said rear end of said elastic piece, in a direction perpendicular to said guide passage.

5. A screw holding type screwdriver bit having, at a tip end of a shaft portion thereof, a plurality of blade portions formed with a substantially perpendicular end edge portion at a tip end of each one of said plurality of blade portions, said screwdriver bit being for a screw having a bit engagement groove of a shape selected from the group consisting of cross, a three way form and polygon, wherein said screwdriver bit comprises:

a cut out portion formed by cutting out one of said plurality of blade portions in a direction of an axis of said screwdriver bit;

a guide passage formed by cutting out a part of said shaft portion of said screwdriver bit for a predetermined length extending from said cut out portion;

a protective sleeve provided on and so as to surround an outer circumference of said shaft portion, in which said guide passage is formed, with tip ends of said blade portions partially exposed; and an elastic piece inserted and disposed between said guide passage extending from said cut out portion and said protective sleeve so that a tip end of said elastic piece, together with said blade portions, is exposed from said protective sleeve and said elastic piece is offset in a radial direction with respect to said cut out portion, and wherein said guide passage has a width at least equal to a thickness of said one of said plurality of blade portions which is cut out, and said elastic piece is inserted and disposed in said guide passage with a part thereof being bent in a redial direction of said shaft portion;

said protective sleeve is fastened, by crimping, at a mounting end thereof to a cut-out formed on an outer circumference of said shaft portion, and a rear end of said elastic piece is contacted to and engaged with an inside of said mounting end of said protective sleeve; and the tip end of said elastic piece, when engaged with a bit engagement groove of said screw by an elastic force that acts in a direction opposite from a radial direction of said screw, holds said screw.

6. A screw holding type screwdriver bit having, at a tip end of a shaft portion thereof, a plurality of blade portions formed with a substantially perpendicular end edge portion at a tip end of each one of said plurality of blade portions, said screwdriver bit being for a screw having a bit engagement groove of a shape selected from the group consisting of cross, a three way form and polygon, wherein said screwdriver bit comprises:

a cut out portion formed by cutting out one of said plurality of blade portions in a direction of an axis of said screwdriver bit and further by cutting out a part of said shaft portion of said screwdriver bit for a predetermined length extending from said one of said plurality of blade portions which is cut out;

a protective sleeve provided on and so as to surround an outer circumference of said shaft portion, in which said cut out portion is formed, with tip ends of said blade portions partially exposed; and an elastic piece is inserted and disposed between said cut out portion and said protective sleeve so that a tip end of said elastic piece, together with said blade portions, is exposed from said protective sleeve and said elastic piece is offset in a circumferential direction with respect to said cut out portion, and wherein said cut out portion forms a guide passage, which is for inserting and disposing therein said elastic piece, together with a bent portion formed by bending a part of said protective sleeve which is provided on the outer circumference of said shaft portion so as to surround said blade portions and elastic piece;

said protective sleeve is fastened, by crimping, at a mounting end thereof to a cut-out formed on an outer circumference of said shaft portion, and a rear end of said elastic piece is contacted to and engaged with an inside of said mounting end of said protective sleeve; and the tip end of said elastic piece, when engaged with a bit engagement groove of said screw by an elastic force that acts in a direction opposite from a screw tightening direction of said screw, holds said screw.

7. A screw holding type screwdriver bit having, at a tip end of a shaft portion thereof, a plurality of blade portions formed with a substantially perpendicular end edge portion at a tip end of each one of said plurality of blade portions, said screwdriver bit being for a screw having a bit engagement groove of a shape selected from the group consisting of cross, a three way form and polygon, wherein said screwdriver bit comprises:

a cut out portion formed by cutting out one of said plurality of blade portions in a direction of an axis of said screwdriver bit and further by cutting out a part of said shaft portion of said screwdriver bit for a predetermined length extending from said one of said plurality of blade portions which is cut out;

a protective sleeve provided on and so as to surround an outer circumference of said shaft portion, in which said cut out portion is formed, with tip ends of said blade portions partially exposed; and an elastic piece is inserted and disposed between said cut out portion and said protective sleeve so that a tip end of said elastic piece, together with said blade portions, is exposed from said protective sleeve and said elastic piece is offset in a circumferential direction with respect to said cut out portion, and wherein said cut out portion, together with a holding pin of an inverted U shape provided in said cut out portion so as to hold a part of said elastic piece therein, forms a guide passage into which said elastic piece is inserted and disposed;

said cut out portion is provided with a holding pin of an inverted U shape for holding a part of said elastic piece therein, thus forming a guide passage into which said elastic piece is inserted and disposed;

said protective sleeve is fastened, by crimping, at a mounting end thereof to a cut-out formed on an outer circumference of said shaft portion, and a rear end of said elastic piece is contacted to and engaged with an inside of said mounting end of said protective sleeve; and the tip end of said elastic piece, when engaged with a bit engagement groove of said screw by an elastic force that acts in a direction opposite from a screw tightening direction of said screw, holds said screw.

* * * * *